US008651895B2

(12) United States Patent
Portmann et al.

(10) Patent No.: US 8,651,895 B2
(45) Date of Patent: Feb. 18, 2014

(54) INTEGRAL CONNECTOR FOR PROGRAMMING A HEARING DEVICE

(75) Inventors: Paul Portmann, Schindellegi (CH); Erich Dittli, Reichenburg (CH); Bruno Gabathuler, Gruningen (CH); Erdal Karamuk, Meilen (CH)

(73) Assignee: Phonak AG, Stafa (CH)

( * ) Notice: Subject to any disclaimer, the term of this patent is extended or adjusted under 35 U.S.C. 154(b) by 39 days.

(21) Appl. No.: 13/500,320

(22) PCT Filed: Oct. 6, 2009

(86) PCT No.: PCT/EP2009/062965

§ 371 (c)(1),
(2), (4) Date: Apr. 5, 2012

(87) PCT Pub. No.: WO2009/153358

PCT Pub. Date: Dec. 23, 2009

(65) Prior Publication Data

US 2012/0202371 A1 Aug. 9, 2012

(51) Int. Cl.
*H01R 13/73* (2006.01)

(52) U.S. Cl.
USPC ..... 439/544; 439/909; 381/324

(58) Field of Classification Search
USPC ..... 439/78, 544, 909; 381/324
See application file for complete search history.

(56) References Cited

U.S. PATENT DOCUMENTS 4,230,387 A * 10/1980 Zahn ..... 439/590
4,641,426 A * 2/1987 Hartman et al. ..... 29/839
4,655,517 A * 4/1987 Bryce ..... 439/83
4,832,622 A * 5/1989 Zahn ..... 439/590
RE33,005 E * 8/1989 Bryce ..... 439/78
4,932,902 A * 6/1990 Crane, Jr. ..... 439/627
5,022,862 A * 6/1991 Martin et al. ..... 439/83
5,169,347 A * 12/1992 Sang ..... 439/885
5,242,311 A * 9/1993 Seong ..... 439/135
5,361,492 A * 11/1994 Miyazawa ..... 29/879
5,370,540 A * 12/1994 Kobayashi ..... 439/78
5,404,407 A * 4/1995 Weiss ..... 381/314
5,533,915 A * 7/1996 Deans ..... 439/678
5,586,188 A * 12/1996 Renggli et al. ..... 381/328
5,733,148 A * 3/1998 Kaplan et al. ..... 439/680
5,775,945 A * 7/1998 Bianca et al. ..... 439/590
5,957,739 A * 9/1999 Bianca et al. ..... 439/885

(Continued)

FOREIGN PATENT DOCUMENTS

DE 10 2005 045 896 A1 4/2007
DE 10 2008 022 926 A1 6/2009

(Continued)

OTHER PUBLICATIONS

International Search Report for PCT/EP2009/062965 dated May 12, 2010.

(Continued)

*Primary Examiner* — Ross Gushi
(74) *Attorney, Agent, or Firm* — Pearne & Gordon LLP

(57) ABSTRACT

For the connection of a programming device to a hearing device an insertable plate (21) into the casing or frame of the hearing device is provided, comprising on one side contacts (29) to the hearing device electronics and on the other side contact pins (27), provided for the connection of a contact adapter/cable system of the programming device.

8 Claims, 3 Drawing Sheets

(56) References Cited

U.S. PATENT DOCUMENTS

Figure 1A:
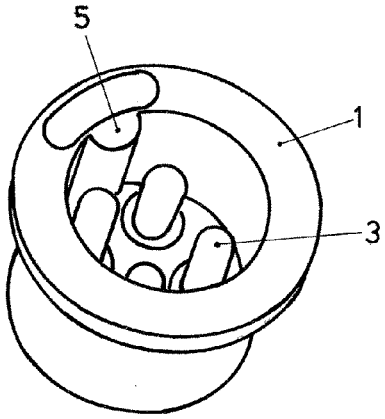
FIG.1a PRIOR ART

| | | | | |
|---|---|---|---|---|
| 6,224,399 | B1 * | 5/2001 | Yacoub | 439/83 |
| 6,875,598 | B1 | 4/2005 | Buggy | |
| 6,976,855 | B2 * | 12/2005 | Kennedy et al. | 439/83 |
| 7,172,439 | B1 * | 2/2007 | Yokobatake et al. | 439/83 |
| 7,749,029 | B1 * | 7/2010 | Pontillo, II | 439/678 |
| 7,896,662 | B2 * | 3/2011 | Chen | 439/83 |
| 7,922,509 | B2 * | 4/2011 | Weber et al. | 439/221 |
| 8,121,327 | B2 * | 2/2012 | Sjursen et al. | 381/323 |
| 8,135,154 | B2 * | 3/2012 | Kramer | 381/330 |
| 8,297,989 | B1 * | 10/2012 | Tang et al. | 439/136 |
| 8,477,977 | B2 * | 7/2013 | Aquilina | 381/323 |
| 2009/0042426 | A1 * | 2/2009 | Kramer | 439/188 |
| 2012/0202371 | A1 * | 8/2012 | Portmann et al. | 439/374 |
| 2012/0224734 | A1 * | 9/2012 | Cohen | 381/322 |
| 2013/0077808 | A1 * | 3/2013 | Bashkaran et al. | 381/328 |

FOREIGN PATENT DOCUMENTS

| | | | |
|---|---|---|---|
| EP | 0702502 | A1 | 3/1996 |
| WO | 98/12897 | A1 | 3/1998 |
| WO | 01/43236 | A1 | 6/2001 |
| WO | 2010/034353 | A1 | 9/2008 |

OTHER PUBLICATIONS

Written Opinion for PCT/EP2009/062965 dated May 12, 2010.

* cited by examiner

INTEGRAL CONNECTOR FOR PROGRAMMING A HEARING DEVICE

The present invention refers to a connecting device for the connection of a programming arrangement to a hearing device according to the preamble of claim 1 and in particular an integral connector to receive a plug connector of a hearing aid programming device.

For the programming of digital hearing devices today several systems are used. Besides wireless programming, which is no topic of the present invention, the programming using a cable connection, which connects the hearing device with a personal computer—directly or via a wireless interface such as NOAHlink by HIMSA—(Hearing Instrument Manufacturer's Software Association) is most commonly used. There are several suppliers of such kind of cables, which also enable the power supply of the hearing device during the programming procedure.

While in many behind-the-ear (BTE) hearing devices the four pin CS44-interface, provided by manufacturers like Knowles and Sonion is very common at in-the-ear devices several systems are used such as e.g. of RTI Corporation, USA. Within the literature also various adapters are described to bridge from a wire system such as e.g. a CS44 onto a connector/interface within the hearing device which is dimension-optimized. Examples of such adapters are described within e.g. U.S. Pat. No. 6,875,598, the WO 01/43236, the EP 702 502, the DE 10 2005 045 896 and the DE 10 2008 022 926.

An essential incentive for the further development of hearing devices is the miniaturization of the systems and as a consequence the more dense integration of components within the hearing device. The today used cables and connectors however are extremely widespread at acousticians and dispensers and the introduction of a new programming cable therefore is associated with high logistic efforts and with high costs. Therefore, suppliers know that the introduction of an additional adapter/cable system for the dispenser is not at all preferred and therefore may create reservations, which could avoid the introduction of a new product into the market. The same of course is valid for a new adapter solution, onto which the dispenser cannot connect his existing cable system.

As a consequence one object of the present invention is to find a solution that allows to reduce the dimension of a hearing device without the need of another connector system or another adapter. In other words, one object is to reduce the dimension of the connecting or adapter system without producing disadvantages as mentioned above compared to the actually used connectors.

As a consequence the present invention proposes a device for the connection of a programming device to a hearing device according to the wording of claim 1.

The basic idea of the present invention is the integration of a commonly used CS44 connector into the supporting structure or casing of a hearing device. According to the invention it is proposed to replace the socket-like connector by using only a contact holder such as e.g. a polymer plate with inserted electrical contact pins and the cylindrical socket casing, which according to the present invention is integral within the polymer frame of the hearing device.

The contact pin holder or polymer plate comprises the four contacts pins, which are provided for the connection with a plug connector of a programming device. The four contact pins correspond in their dimensions and their arrangement to the original socket as shown in FIGS. 1*a* and 1*b*.

The invention shall be described in more details and via examples with reference to the attached figures.

Within the figures

Figure 1B:
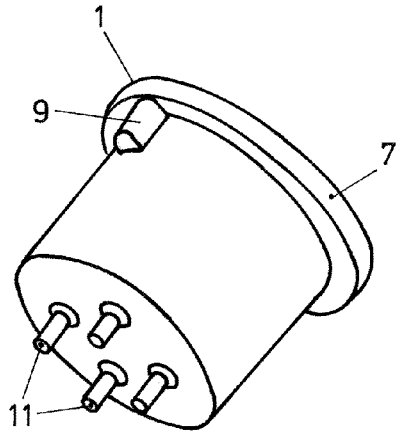
FIG.1b PRIOR ART
Figure 2A:
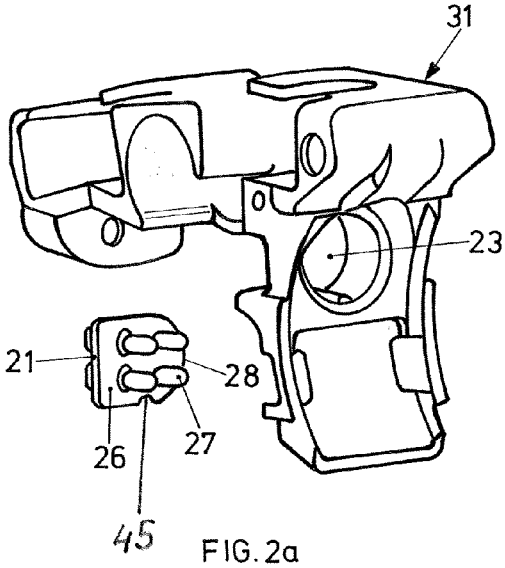
Figure 2B:
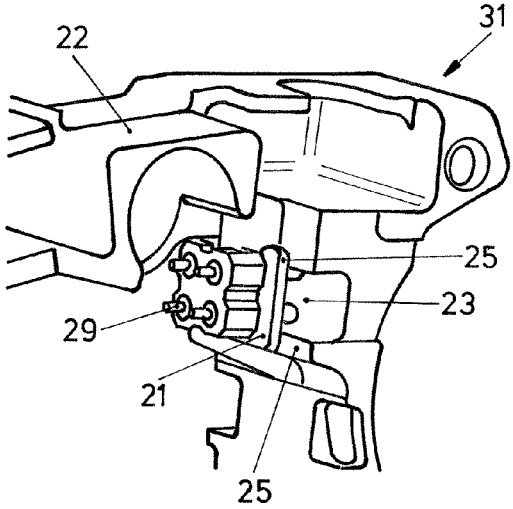
Figure 3A:
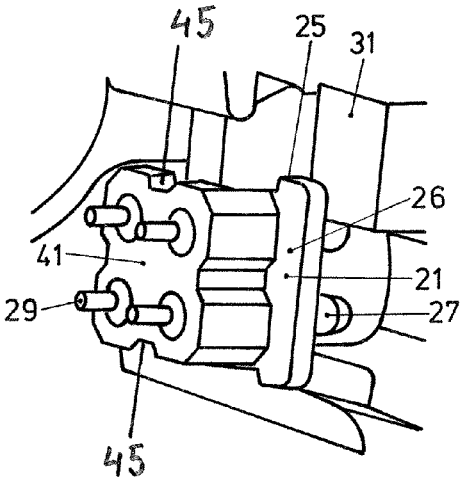
Figure 3B:
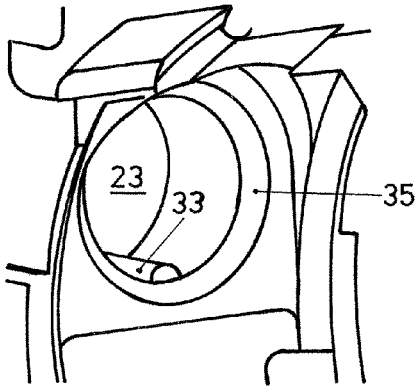
Figure 4:
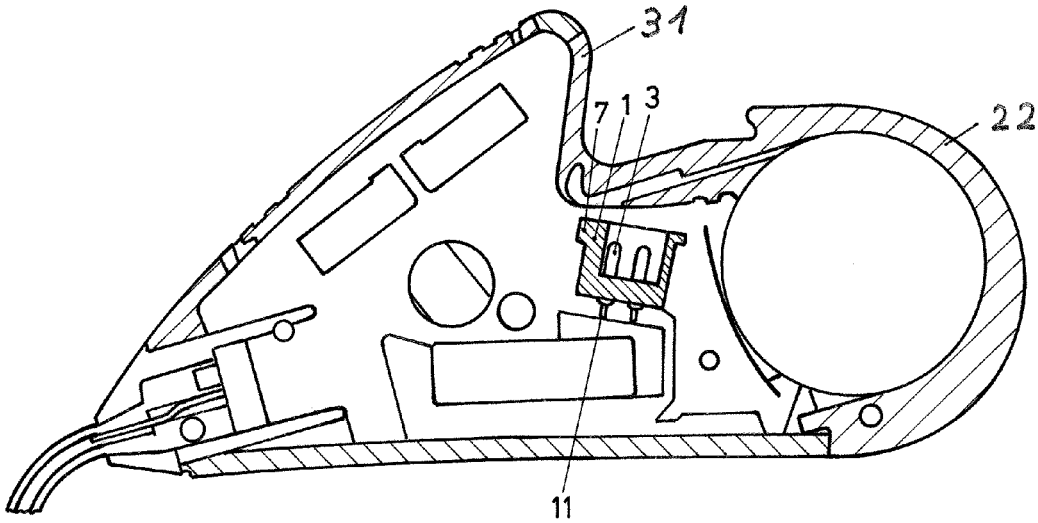
FIG.4 PRIOR ART
Figure 5:
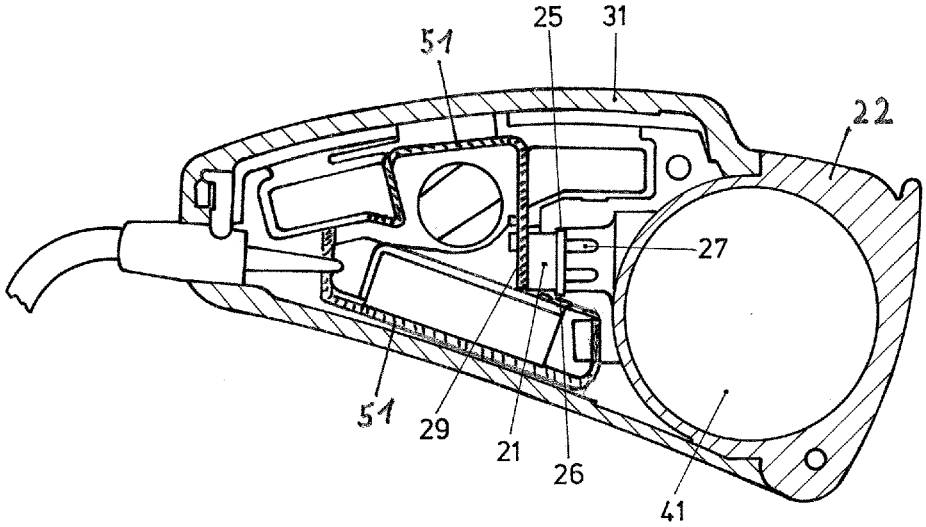

FIG. 1*a* and 1*b* show a connector socket as known in the state of the art;

FIGS. 2*a* and 2*b* the frame of a hearing device in perspective view with the contact pin holder removed and the contact pin holder inserted into the frame;

FIGS. 3*a* and 3*b* sections of the frame of FIG. 2 in enlarged view;

FIG. 4 a sectional view of a hearing device frame with a socket as known in the state of the art, and FIG. 5 a sectional view of a hearing device frame with a contact pin holder according to the present invention.

FIGS. 1*a* and 1*b* show a connector socket 1 as known in the state of the art.

Four electric contact pins 3 are arranged in a square-like arrangement within the interior of the socket. Within the socket there is a projecting guiding part 5, which at the insertion of the plug connector of the programming device is inserted into a respective notch and which is an orientation aid for the accurate insertion of the plug. In addition, this projection shields the contacts of the plug from a torsional force.

The cylindrical body or socket can be inserted into a respective bore within the hearing device housing or hearing device frame. A projecting collar 7 of the socket is bearing on a respective frame of the bore at the insert to absorb axial forces at the insertion of the plug connector into the socket.

On the outside rim of the socket a polymer lug 9 is projecting, which can be inserted within a respective notch within the hearing device housing or frame and which is an orientation aid at the insertion of the socket into the hearing device.

Projecting connecting wire-pins 11 are provided for the connection of the socket with the hearing aid electronics. The wire-pins can be either connected to by soldering to wires or can be soldered directly onto a printed circuit board (PCB).

As already mentioned above the main objective of the present invention is to reduce the dimensions of the connector socket what will lead to a reduction of the dimensions of the hearing device itself.

With reference to FIGS. 2*a* and 2*b* it is shown how the inventively proposed contact pin holder may be inserted into a hearing device frame. The inventive contact pin holder 21 comprising the contact pins 27 for the connection to an adapter of a programming device is to be inserted into a hearing device frame 31 comprising a battery compartment 22 (FIG. 5) and a bore 23 for the insertion of the adapter of the programming device.

As shown in FIG. 2*b* the contact holder 21 can be inserted into the frame 31 via respective guiding notches 25 such that after insertion the contact pins are arranged within the bore 23 of the hearing device frame. As seen in FIG. 2*b* on the opposite side to the contact pins 27 on the contact holder plate 21 the contact wire-pins 29 are arranged for the connection to respective electronic connections to the hearing device.

In FIGS. 3*a* and 3*b* details of the hearing device frame of the FIGS. 2*a* and 2*b* are shown in enlarged view.

FIG. 3*a* shows the inserted contact pin holder plate 21 within the hearing device frame 31.

The base plate of the contact holder 21 is inserted within guiding notches 25, the contact pins 27 projecting into the socket casing 23 of the hearing device frame 31. The contact pin holder 21 comprises the following features:

- A completely surrounding projecting frame 26 comprising three straight sides and one side 28, which is curved as can be seen in FIG. 2*a*.
- Four contact wire-pins 29 which are arranged and correspond to the original socket as described with reference to FIG. 1*a* and 1*b*.

Respective notches within the frame of the hearing device to receive the base plate of the contact pin holder in position.

Respective grooves within either the plate or within the notches may ensure that the base plate of the contact pin holder is kept in correct position.

The socket housing 23 within the hearing device frame 31 comprises the following features:

A tapered collar 35 for enabling a correct introduction of the plug connector of the programming device.

A projecting rib 33 along the bore of the socket boring 23 as orientation aid at the insert of the plug connector.

The great advantage of the present invention will become obvious when comparing a programming socket as known in the state of the art with a programming socket as proposed according to the present invention.

FIG. 4 shows in sectional view a hearing device casing 31 with an inserted and arranged programming socket 1 with its contact pins 3 and 11 for the connection of a plug connector of a programming device to the electronics of the hearing device. The socket 1 is held in position by means of the projecting collar 7 of the housing of the programming socket.

FIG. 5 shows a programming socket according to the present invention firmly arranged on the respective Printed Circuit Board (PCB) 51. The contact pin holder 21 is inserted with its base plate 26 within respective notches 25 arranged within the frame 31 of a hearing device. The respective contact pins 27, which correspond to the contact pins 3 of the socket as shown in FIG. 4, are easily accessible from the battery compartment 41. In addition the contact wire-pins 29 again correspond to the contacts 11 of the socket 1 as shown in FIG. 4. It becomes quite apparent that the socket or contact pin holder 21 as shown in FIG. 5 is smaller than the respective programming socket as shown in FIG. 4. In other words by using the inventive contact holder also the surrounding hearing device can be made of smaller dimensions compared with the hearing device as shown in FIG. 4. This due to the fact that there is no need for a socket housing, which means in practice that in diameter and length-wise the programming device connector within the hearing device can be made more compact. Spoken in concrete figures a reduction in the range of 2-4 mm can be achieved by this invention. In addition, the possibility of inserting the contact holder from one side is far easier than the introduction or insertion of the programming socket as shown in FIG. 4, since it can be premounted on the PCB 51 with the other electronic components and the bent PCB 51 can be slid in from one side in a folded manner into the frame, as shown in FIG. 5. This reduces the manufacturing effort of the hearing device, since many assembly steps can be omitted. Finally, the production of the contact pin holder is easier than the production of the programming socket as shown in FIG. 1 and FIG. 4 because the dimensional tolerances are less critical and the tooling is simpler as well.

As a consequence the connecting device or contact pin holder as proposed according to the present invention is easier to be produced and cheaper in production. As a consequence also replacement and repair of the contact pin holder is easier and less expensive.

The contact pin holder or connecting device for a programming device as shown in FIGS. 2, 3 and 5 is of course only representing one example and can be changed or modified in any manner. Using four contact pins and four contact wire-pins is preferred, so that the already used adapters and plug connectors for programming devices do not have to be changed. Of course there is also the possibility of using three, five, six or more contact pins and contact wire-pins respectively. Also the base plate of the contact pin holder may have different dimensions and also the material for the production of the contact holder is no basic topic of the present invention. By choosing the material, one must consider only its mechanical and thermal stability, since the contact pin holder could be assembled on the PCB by standard surface mount technology, which would require it to withstand the temperatures in a reflow process or the contact wire pins 29 can be put through holes in the PCB and soldered manually. To be suitable for both assembly procedures the polymer material of the contact pin holder must be chosen from a selection of high performance thermoplastics, such as e.g. polyethteretherketone (PEEK), liquid crystal polymer (LCP, e.g. Vectra) or polysulfone (PSU). Of course also other suitable specific polymer materials can be used.

The invention claimed is:

1. A connection device for the connection of a programming device to a hearing device comprising a bore for the insertion of a plug connector or programming device, the connection device comprising an insertable plate (21) inserted into a casing or frame of the hearing device, the insertable plate comprising on one side contacts (29) to connect to the hearing device electronics and on another side contact pins (27) to connect to a contact adapter/cable system of the programming device, the hearing device casing or frame comprising grooves or notches (25) provided for the insertion and correct positioning of the plate from one side into the frame or housing such that after insertion the contact pins are arranged within the bore of the hearing device frame.

2. The connection device according to claim 1, characterized in that insertion grooves (45) at the plate are provided for the insertion and correct positioning of the plate which is designed as a contact pin holder.

3. The connection device according to claim 1, characterized in that the insertable plate is arranged such that it is accessible from outside the hearing device casing or frame, such that the contact pins are accessible from outside the hearing device casing or frame.

4. The connection device according to claim 1, characterized in that a socket or insertion hole (23) for the connection of an adapter of a programming device is integrally arranged within the hearing device casing or frame.

5. The connection device according to claim 4, characterized in that the socket or hole (23) integrally shaped within the hearing device casing comprises a collar section (35) shaped conically towards the inside to enable a centered introduction of the adapter of the programming device into the hole or socket towards the insertable plate.

6. The connection device according to claim 4 or 5, characterized in that within the hole or socket, means are provided as orientation aid when inserting the adapter of the programming device into the hole or socket.

7. The connection device according to claim 1 or 2, characterized in that fixation or centering means are provided at either the contact pin holder or within the grooves or notches of the hearing device frame to keep the contact pin holder in a correct position when being inserted into the grooves or notches of the hearing device frame or housing.

8. A method of assembling a hearing device comprising: providing a printed circuit board onto which electronic components and an insertable plate or contact pin holder respectively are electrically and mechanically connected; providing a hearing aid frame or housing comprising grooves or notches and a bore; sliding the printed circuit board in a folded fashion into the frame or housing from one side such that the insertable plate or contact pin holder respectively engages with the grooves or notches inside the frame or housing thus together with the bore forming a programming socket which is accessible from the outside to insert a plug connector.

* * * * *